US005085142A

United States Patent [19]

Smith

[11] Patent Number: 5,085,142

[45] Date of Patent: Feb. 4, 1992

[54] DAMPENING FLUID EVAPORATOR

[76] Inventor: Maurice D. Smith, 4440 Northcrest, Dallas, Tex. 75229

[21] Appl. No.: 622,323

[22] Filed: Nov. 28, 1990

Related U.S. Application Data

[63] Continuation of Ser. No. 165,519, Mar. 8, 1988, abandoned.

[51] Int. Cl.[5] ..... B41F 7/26; B41F 7/36

[52] U.S. Cl. ..... 101/148

[58] Field of Search ..... 101/147, 148, 141, 144, 101/349, 350; 34/114, 122

[56] References Cited

U.S. PATENT DOCUMENTS

| | | | |
|---|---|---|---|
| 1,022,379 | 4/1912 | Pope | 34/114 X |
| 1,212,643 | 1/1917 | Hopewell | 34/114 X |
| 2,196,412 | 4/1940 | Greenbeck | 101/147 |
| 2,733,653 | 2/1956 | Mullen | 101/147 |
| 2,843,040 | 7/1958 | Childers | 101/141 |
| 4,452,139 | 6/1984 | Dahlgren et al. | 101/148 |
| 4,470,347 | 9/1984 | Johne et al. | 101/148 |
| 4,524,689 | 6/1985 | Lemaster | 101/141 |
| 4,527,471 | 7/1983 | Dahlgren et al. | 101/148 |
| 4,753,165 | 6/1988 | Grosshauser | 101/148 |

FOREIGN PATENT DOCUMENTS

| | | | |
|---|---|---|---|
| 925116 | 3/1955 | Fed. Rep. of Germany | 101/147 |
| 929612 | 6/1955 | Fed. Rep. of Germany | 101/147 |
| 2658875 | 6/1978 | Fed. Rep. of Germany | 101/147 |
| 461042 | 1/1951 | Italy | 101/147 |
| 256858 | 9/1948 | Sweden | 101/147 |

OTHER PUBLICATIONS

Dayton Transflow Blower Model 4C874–Operating Instructions and Parts Manual–Form 5S2814–Dayton Electric Manufacturing Co.

*Primary Examiner*—J. Reed Fisher

*Attorney, Agent, or Firm*—Crutsinger & Booth

[57] ABSTRACT

A dampening fluid evaporator for a lithographic printing press incorporating a blower housing having an elongated inlet passage positioned to extend along substantially the entire length of a distributor roller. A transflow blower mounted in the blower housing draws air through the elongated intake passage along substantially the entire length of the roller while delivering a diffused stream of air which impinges against the roller for evaporating excess dampening fluid.

16 Claims, 3 Drawing Sheets

DAMPENING FLUID EVAPORATOR

This is a continuation of application Ser. No. 07/165,519 filed 03/08/88, now abandoned.

TECHNICAL FIELD

The invention relates to lithographic printing presses and more particularly concerns a roller driven fan for evaporating dampening fluid which infiltrates the ink train during the lithographic printing process.

BACKGROUND OF THE INVENTION

The inevitable infiltration by dampening fluid into the ink train system of lithographic printing presses is well known in the art. The presence of dampening fluid in the ink train adversely affects both image quality and color consistency. Previous attempts to eliminate dampening fluid from the ink train of lithographic printing presses have proved costly, complex, and generally involve elaborate plumbing networks which pipe air from air compressors, to air jet manifolds or nozzles which direct streams of air to impinge against inker rollers to evaporate excess dampening fluid. Typical systems are disclosed in U.S. Pat. No. 4,524,689 entitled "DEHYDRATION APPARATUS FOR PRINTING PRESS INKING SYSTEM" and U.S. Pat. No. 4,452,139 entitled "DAMPENING FLUID EVAPORATOR AND METHOD".

The use of air compressor units for delivering pressurized air to jet manifolds or nozzles within the printing press is expensive in terms of power consumption, floor space, and plumbing costs. Further, air bars and manifolds sometimes limit access to the rollers in the press. Since it is desirable to control such evaporative systems in conjunction with the operation of the ink train to prevent excessive drying of the rollers when the press is momentarily stopped or otherwise not applying ink to the printing plate through the inking rollers; compressors must be either manually turned off during periods of roller inactivity or the cost and complexity of the evaporative system must be increased further by the incorporation of automatic power or pneumatic relays.

SUMMARY OF THE INVENTION

A primary object of the invention is to provide a method and apparatus for easily and inexpensively evaporating excess dampening fluid from the ink train of a lithographic printing press. The apparatus disclosed herein comprises an elongated transverse-flow fan impeller positioned to blow air on rollers in an ink train for evaporating dampening fluid. The evaporative system operates in conjunction with the ink train and automatically discontinues operation when the inker rollers are momentarily stopped.

The improved method of evaporating liquid from the surface of a roller generally comprises the steps of mounting a transflow blower for rotation about a longitudinal axis which is spaced from and parallel to an axis about which the roller in the lithographic printing press rotates; rotating the roller; and driving the fan through a pulley and belt drive such that rotation of the roller imparts force to drive the fan such that the speed of rotation of the fan changes when the speed of rotation of the roller changes.

The dampening fluid evaporator includes a blower mounted adjacent a roller in a lithographic printing press to deliver air toward the surface of the roller to evaporate dampening fluid from the surface of the roller.

The blower is driven by a drive member operably connected to the roller; a driven member operably connected to the blower; and an elongated flexible drive member driven by the drive member on the roller for imparting force to drive the blower.

The blower has a plurality of blades, each of the blades having a tip and a heel mounted between end shrouds such that the tip of each blade points in the direction of rotation and such that the heel of each blade is positioned circumferentially rearly of the blade tip to form forwardly curved blades to draw and deliver air substantially tangentially of the impeller of the blower.

In accordance with the invention there is provided a method of evaporating dampening fluid from the surface of a roller in an ink train, incorporating an elongated fan positioned adjacent a roller and coupled to the roller such that rotation of the roller imparts force to drive the fan. The fan speed is controlled by the speed of rotation of the roller and requires no external source of power.

BRIEF DESCRIPTION OF THE DRAWINGS

Drawings of a preferred embodiment of the invention are annexed hereto so that the invention may be better and more fully understood, in which.

Numeral references are employed to designate like parts throughout the various figures of the drawing.

DESCRIPTION OF A PREFERRED EMBODIMENT

Figure 1:
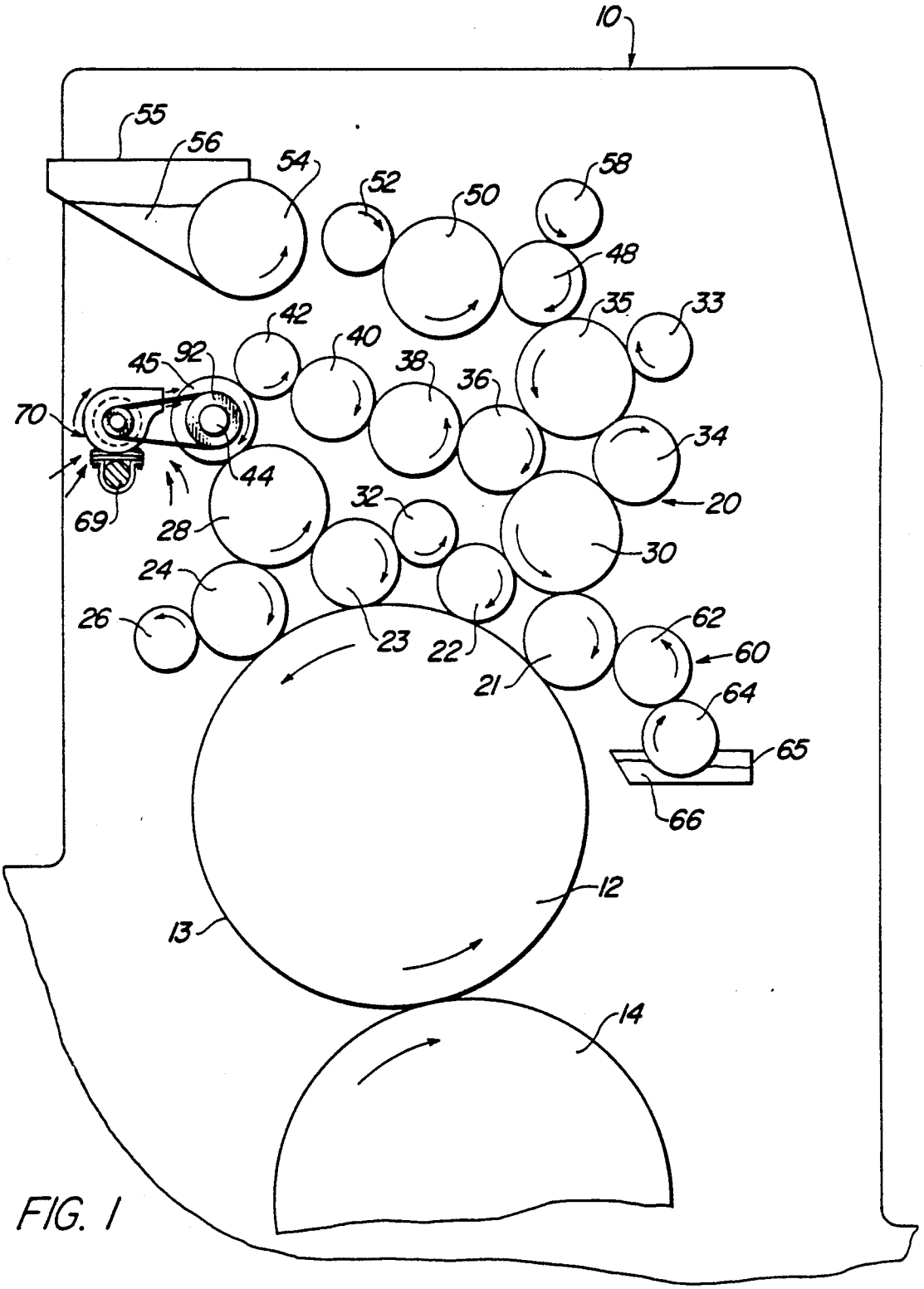
FIG. 1 is a schematic illustration of a lithographic printing press showing an end view of the dampening fluid evaporator assembly.

A dampening fluid evaporator, generally designated by the numeral 70, is illustrated in FIG. 1 of the drawing to evaporate excess dampening fluid from rollers in an inker system generally designated by the numeral 20 in a printing press.

The printing press, generally designated by the numeral 10, is of conventional design and comprises a plate cylinder 12 having a printing lithographic plate 13 mounted on the surface thereof in rolling engagement with a blanket cylinder 14 rotatably supported between press side frames 15 and 16.

Inker 20 is of conventional design and comprises resilient surfaced inker form rollers 21, 22, 23 and 24 which apply ink and dampening fluid to the surface of lithographic printing plate 13. An equalizer roller 26 is in rolling engagement with the last ink form roller 24. Vibrator rollers 28, 30 and 32 oscillate longitudinally relative to form rollers 21, 22, 23 and 24 for distributing ink onto the surface of the rollers and to eliminate "ghosting".

Ink is delivered to vibrator rollers 28 and 30 over ink supply rollers 34 and 36. Ink supply roller 36 delivers ink to the surfaces of ink distributor rollers 38, 40, 42 and 45, as will be hereinafter more fully explained. An equalizing roller 33 is in rolling engagement with roller 35 which engages ink supply rollers 34 and 36 and receives ink from ink supply rollers 48 and 50. A ductor roller 52 oscillates between fountain roller 54 and ink supply roller 50. Fountain roller 54 is submerged in a supply of ink 56 in ink reservoir 55. Rollers 33 and 58 function as ink storage rollers engaging supply rollers 35 and 48 to equalize films and split films of ink carried by the surfaces of the rollers of the train of rollers in inker 20 enroute to the surface of printing plate 13. Inker 20 is of conventional design and may assume other and further configurations.

The dampener system generally designated by the numeral 60 is of conventional design and preferably is of the type disclosed in U.S. Pat. No. 3,343,484 for forming a thin film of dampening fluid and applying the film to the first inker form roller 21. Dampener 60 generally comprises a hydrophilic transfer roller 62 in pressure indented relation with a resilient covered metering roller 64 which receives dampening fluid 66 from a reservoir 65. As metering roller 64 rotates, dampening fluid is carried on its surface to the nip between metering roller 64 and transfer roller 62. The surface speed of transfer roller 62 controls the rate at which a film of dampening fluid is offered to the surface of the first inker form roller 21. The dampening system 60 is of conventional design and may assume other and further configurations.

From the foregoing it should be readily apparent that ink from the ink reservoir 55 is delivered over a train of rollers in inker 20 and combined with a film of dampening fluid supplied by dampener 60 for application to the lithographic printing plate 13. The inker 20 and dampening system 60 form no part of the present invention except in combination with the dampening fluid evaporator 70.

As is well known to persons skilled in the art, the film of dampening fluid formed by the dampening system 60 is applied to the surface of ink on the first inker form roller and dampens the hydrophilic non-image areas on the surface of printing plate 13 while ink is transferred to image areas on printing plate 13. Some of the dampening fluid applied to printing plate 13 is transferred to the subsequent form rollers 22, 23 and 24 while a portion of the film of dampening fluid which remains on the first form roller 21 is transferred over roller 30 to other rollers in the inking system 20.

Dampening fluid evaporator 70 is preferably mounted to evaporate excess dampening fluid from the surface of ink distribution roller 45 to prevent accumulation of excessive quantities of dampening fluid on the surfaces of the train of rollers in inker 20.

Figure 3:
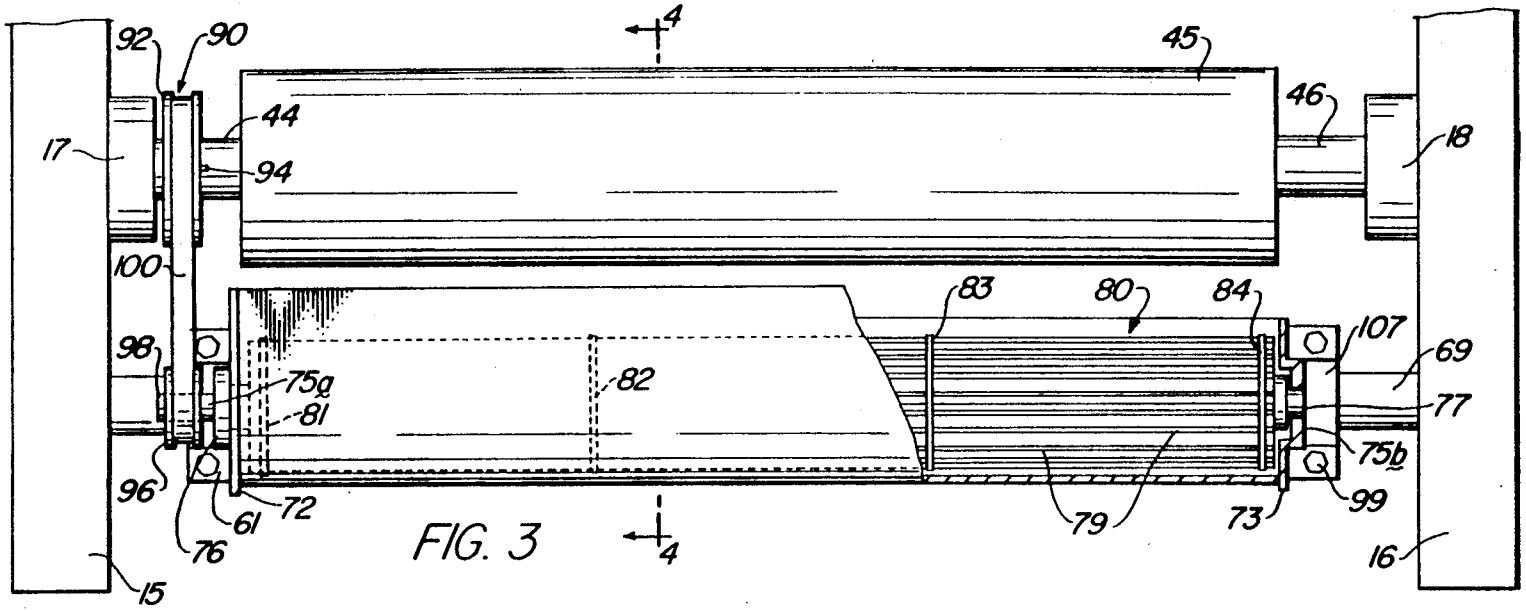
FIG. 3 is a top plan view of the dampening fluid evaporator assembly.

As best illustrated in FIGS. 1 and 3 of the drawing, ink distribution roller 45 has journals 44 and 46 formed on opposite ends thereof which are rotatably supported in bearings 17 and 18 on press sideframes 15 and 16. Suitable drive means 90 is provided to transfer driving force from ink distributor roller 45 to the dampening fluid evaporator 70.

In the illustrated embodiment, the drive means includes a pair of pulleys 92 and 96 and a flexible drive member 100. Pulley 92 is secured by a key 94 to journal 44 of ink distribution roller 45. Force is imparted to drive dampening fluid evaporator 70 by belt 100 which is positioned around pulley 92 and pulley 96 which is secured to tail shaft 75*a* of dampening fluid evaporator 70 by a key 98. Ink distribution roller 45 rotatively contacts vibrator roller 28 which is rotated and oscillated axially by a system of gears (not shown) within printing press 10. Ink distribution roller 45 is rotated in response to frictional forces imparted by the rotation of gear driven vibrator roller 28. It will of course be appreciated that dampening fluid evaporator 70 can alternately be driven by an electrical motor or by a gear system within the printing press 10 without departing from the scope and spirit of the invention.

Figure 2:
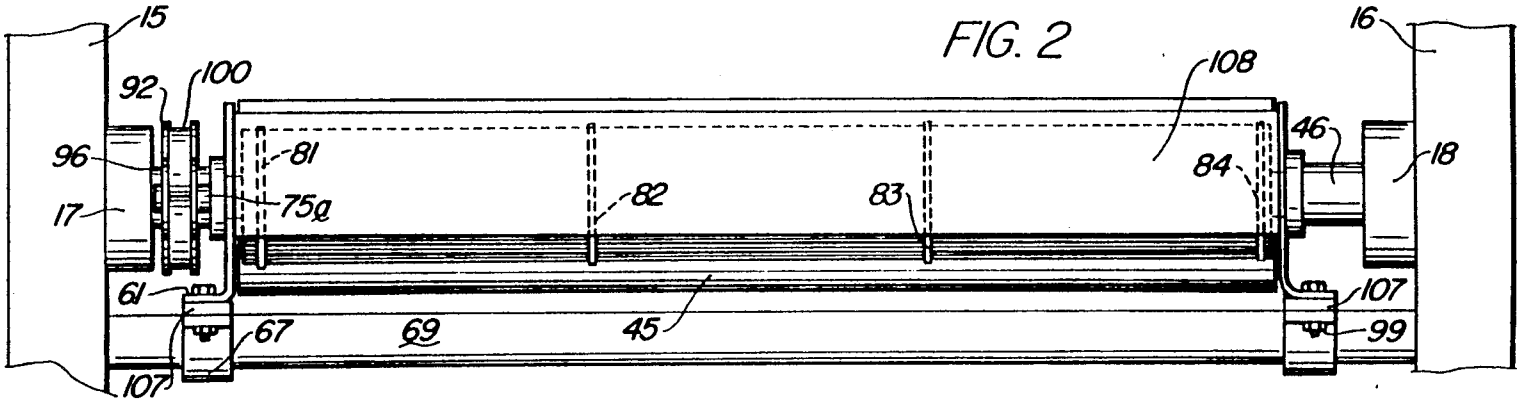
FIG. 2 is a rear elevational view of the dampening fluid evaporator assembly.
Figure 5:
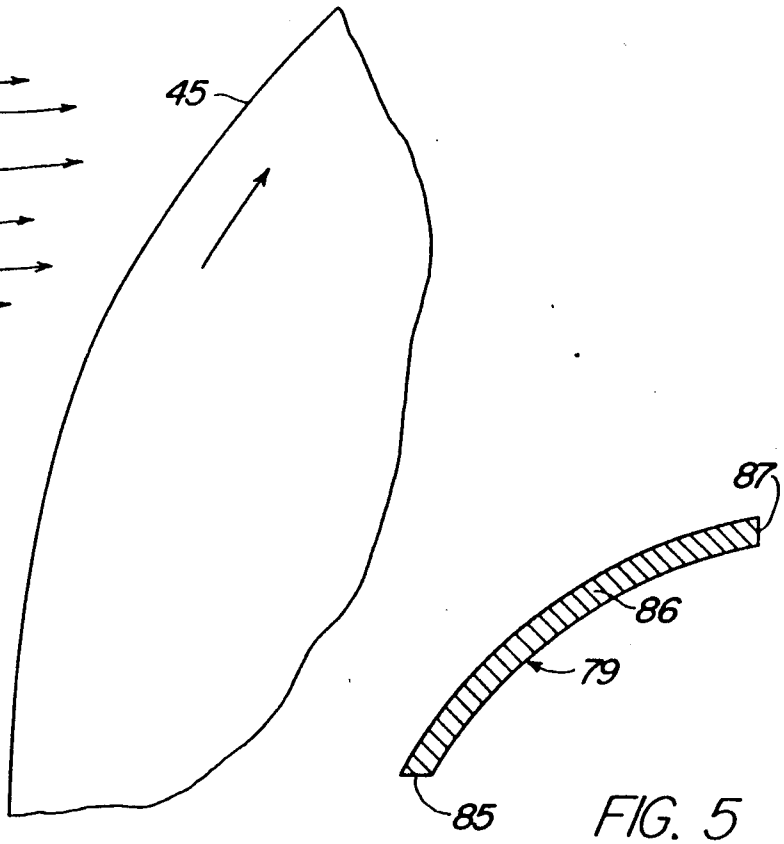
FIG. 5 is an enlarged cross-sectional view of a blade.
Figure 4:
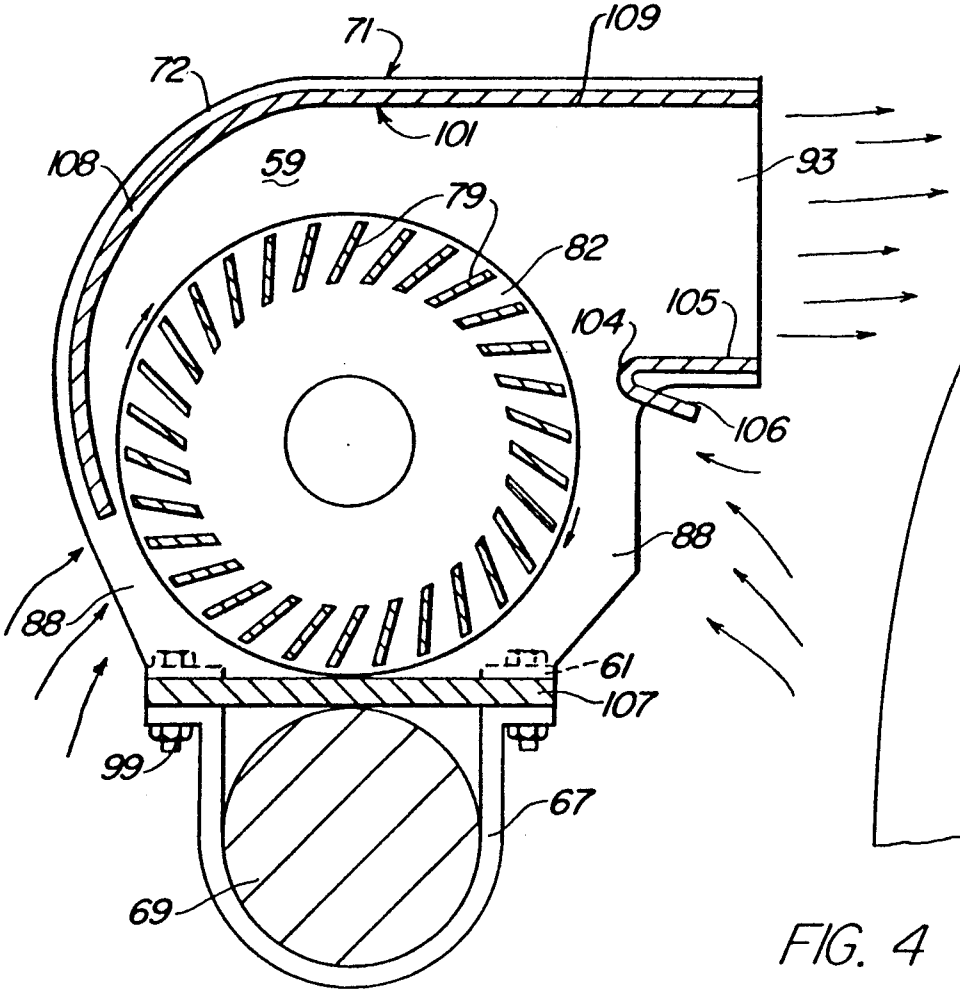
FIG. 4 is a cross-sectional view taken along line 4—4 of FIG. 3.

Referring now to FIGS. 2, 3 and 4 of the drawing, dampening fluid evaporator 70 comprises an elongated fan assembly in a housing 71 having end shrouds 72 and 73, tail shafts 75*a* and 75*b*, end bearings 76 and 77, and an impeller generally designated by the numeral 80.

The fan incorporated into the evaporator 70 is commercially available from Dayton Electric Manufacturing Co. of Chicago, Ill. and is generally referred to as a "Dayton" transflow blower Model 4C874. The blower is a single speed unit designed for heating, cooling, exhausting, ventilating and drying applications. The blowers are conventionally driven by a shaded-pole motor with automatic-reset thermal protection. Dayton form 5S2814, which is incorporated herein by reference in its entirety, contains a description and specifications of the blower.

The transverse-flow fan illustrated in FIGS. 2–4 advantageously causes the air to pass through the blades 79 twice, entering substantially tangentially through the tip, passing across the impeller 80 and out the other side. The fan housing 71 is designed to provide the transverse flow of air. The end shrouds 72 and 73 have no inlet holes. It should be appreciated that since the fan impeller 80 does not depend upon flow of air in an axial direction, the blade length and tip diameter ratios are limited only by structural considerations. Thus, the impeller 80 having an outside diameter of approximately 2.5 inches and a length for example, 38 inches provides a substantially uniform flow of air along the length of the impeller 80.

Impeller 80 comprises spaced circular retaining end plates 81 and 84, stabilizing plates 82 and 83, and a plurality of fan blades 79, each fan blade 79 having a heel 85, a curved central body portion 86, and a tip 87.

As best shown in FIGS. 3 and 4 of the drawing, fan blades 79 are perpendicularly disposed relative to press side frames 15 and 16 and are secured between retaining plates 81 and 84 in circular fashion relative to retaining plates 81 and 84 such that fan blades 79 are symmetrically disposed at equidistant intervals along the periphery of retaining plates 81 and 84 forming a cylindrical impeller 80. Fan blades 79 are angularly disposed between retaining plates 81 and 84 such that as impeller 80 is rotated, the tip 87 of each fan blade 79 serves as a leading edge of the fan blades 79 and the heel 85 serves as a trailing edge of fan blade 79 relative to the direction of rotation. Fan blades 79 are provided with a shallow forward curved central body portion 86 which points both tip 87 and heel 85 in the direction of rotation of the impeller 80. Stabilizing plates 82 and 83 are positioned between and at equidistant intervals from retaining plates 81 and 84. Fan blades 79 extend longitudinally through corresponding slots (not shown) in stabilizing plates 82 and 83. Stabilizer plates 82 and 83 are essentially "washer shaped", having a circular configuration of equal diameter as retaining plates 81 and 84, substantially flat surfaces disposed perpendicularly to fan blades 79, and a central bore therethrough.

Retaining plates 81 and 84 are secured to shafts 75*a* and 75*b* which extend through bearings 76 and 77, respectively along a central axis 74 for permitting rotation of impeller 80 around central axis 74. End bearing 77 is secured to the end shroud 73 of housing 71. End bearing 76 is secured to the end shroud 72 of housing 71. End shroud 72 has an aperture 78 aligned with central axis 74 for permitting the tail shaft 75*a* extending through end bearing 76 to extend longitudinally through aperture 78 to the outside of housing 71. Pulley 96 is secured to tail shaft 75*a* by key 98.

As best shown in FIGS. 1, 3 and 4, housing 71 comprises a cover shield 101, and a directional member 104 positioned in spaced apart relation around impeller 80 and secured between end shrouds 72 and 73. Cover shield 101, directional member 104, and end shields 72 and 73 substantially enclose impeller 80 and cause air to be channeled through the openings therebetween, said openings serving as air intake vent 88 and blower port 93.

Cover shield 101 having a curved rear portion 108 and a substantially straight front portion 109 is axially positioned above and adjacent to impeller 80 such that the curved rear portion 108 is positioned in eccentric alignment around impeller 80 and the front portion 109 extends away from impeller 80 toward ink distribution roller 45 for channeling air from impeller 80 and directing air to impinge on ink distribution roller 45. The eccentric alignment of the curved rear portion 108 of cover shield 101 and impeller 80 forms a progressively expanding air acceleration chamber 59 between cover shield 101 and impeller 80 extending from the rear of impeller 80 and tapering outwardly to blower port 93.

Directional member 104 comprises an angular channel having an upper fin 105 and a lower fin 106 and is positioned between impeller 80 and ink distribution roller 45. Directional member 104 is perpendicularly aligned relative to side frames 15 and 16 and secured at its ends to end shrouds 72 and 73. Upper fin 105 of directional member 104 is aligned in parallel spaced apart relation to front portion 109 of cover shield 101, the space therebetween forming blower port 93 for directing air from impeller 80 to impinge against ink distribution roller 45. Lower fin 106 is angularly inclined relative to upper fin 105.

End shrouds 72 and 73 enclose the ends of evaporator 70, the lower portion of each having a pair of outwardly extending anchor lugs 61. Mounting plates 107 extend perpendicular relative to axis 74, spanning the distance between the corresponding anchor lugs 61 and secured to the bottom of evaporator 70 by means of bolts 99 extending through anchor lugs 61. Similarly, the curved portion 108 of cover shield 101 and lower fin 106 of directional member 104 are positioned on opposite sides of impeller 80, the space therebetween and beneath impeller 80 forming air intake vent 88.

U-clamps 67 and 68 are positioned around a tubular cross member 69 in printing press 10 and secured to evaporator 70 by means of bolts 99 extending through anchor lugs 61 and mounting plate 107 grippingly engaging tubular cross member 69 between clamps 67 and 68 and mounting plate 107 for securing evaporator 70 in printing press 10. Tubular cross member 69 is a convention structural component in printing press 10 and is disposed in perpendicular relation to side frames 15 and 16. It will of course be appreciated that evaporator 70 may be secured within printing press 10 in a variety of ways, (i.e., by brackets mounted on side frames 15 and 16) depending upon the structural configuration of the particular printing press 10.

As will be readily apparent from the description of the preferred embodiment heretofore discussed, rotation of impeller 80 draws air through air intake vent 88, passes air through an air acceleration chamber 59, and exhausts air through blower port 93 to impinge against ink distribution roller 45 for evaporating excess dampening fluid from the inking system 20 of printing press 10. The method and operation of the dampening fluid evaporator described and illustrated in conjunction with the drawing is believed to be readily understandable by those skilled in the art. Dampening fluid is evaporated from the surface of a roller 45 in inking system 20 by positioning a fan 80 adjacent roller 45 and providing appropriate drive means 90 coupling roller 45 and fan 80 such that the rotation of roller 45 imparts force to drive fan 80 causing air to impinge against roller 45 for evaporating dampening fluid on the surface of roller 45. According to a preferred embodiment of the present invention, a transflow blower 80 is mounted in a printing press 10, parallel and adjacent to ink distribution roller 45 and driven by a flexible belt mounted around a drive pulley secured to roller 45, and a driven pulley secured to transflow blower 80.

Although a preferred embodiment of the invention has been described herein those skilled in the art will also appreciate that various substitutions and modifications may be made to the specific arrangement described without departing from the scope and spirit of the invention as recited in the appended claims.

What is claimed is:

1. A method of evaporating liquid from the surface of a roller which rotates about an axis in a printing press comprising the steps of: rotating a roller; supporting fan means having blade means extending longitudinally of substantially the entire length of the roller such that ends of the blade means are positioned adjacent opposite ends of the roller in the printing press; and coupling the fan means such that rotation of the roller imparts force to drive the blade means such that the speed of rotation of the blade means changes when the speed of rotation of the roller changes.

2. A method according to claim 1, the step of coupling the fan means such that rotation of the roller imparts force to drive the blade means comprising: providing a drive pulley to rotate with the roller; providing a driven pulley to rotate with the blade means; and mounting a belt on the drive pulley and the driven pulley such that the belt imparts force to the driven pulley for rotating the elongated blade means.

3. A method according to claim 1, the step of supporting fan means comprising the steps of: mounting a transflow blower having elongated blades for rotation about a longitudinal axis which is spaced from and parallel to an axis about which the roller in the printing press rotates and such that opposite ends of the elongated transflow blower are positioned adjacent opposite ends of the roller to draw and deliver air transversely of the roller while minimizing air flow in a direction parallel to the axis of the transflow blower.

4. A dampening fluid evaporator adapted to be mounted to evaporate dampening fluid from a roller rotatable about a roller axis in a lithographic printing press comprising: an elongated transflow blower having elongated blades, a longitudinal axis and spaced ends; mounting means to mount said transflow blower adjacent the roller in a lithographic printing press, said mounting means being adapted to position opposite ends of said blower adjacent opposite ends of the roller such that said elongated blades extend generally parallel to the roller axis; and drive means to rotate said transflow blower to draw air transversely of said blower, along substantially the entire length of the roller, and to deliver air toward the roller to evaporate dampening fluid from the roller.

5. A dampening fluid evaporator for a lithographic printing press according to claim 4, said drive means to rotate said transflow blower comprising: a drive member adapted to be operably connected to the roller; a driven member operably connected to said transflow blower; and elongated flexible drive means driven by said drive member for impairing force to said driven member.

6. A dampening fluid evaporator for a lithographic printing press according to claim 5, said drive member and said driven member comprising: pulleys, and wherein said elongated flexible drive means comprises a drive belt.

7. A dampening fluid evaporator for a lithographic printing press according to claim 5, said mounting means to mount said transflow blower adjacent a roller in a lithographic printing press comprising: a blower housing having a length substantially equal to the length of the roller; means rotatably securing said transflow blower in said blower housing; and means to mount said blower housing in a printing press such that opposite ends of said blower housing are positioned adjacent opposite ends of the roller.

8. A dampening fluid evaporator for a lithographic printing press according to claim 7, said mounting means to mount said blower housing comprising: a mounting plate, and means to secure said mounting plate relative to an inker side frame.

9. A dampening fluid evaporator adapted to be mounted on a lithographic printing press to evaporate dampening fluid carried on the surface of a roller rotating about a roller axis comprising: a blower housing having an elongated intake opening and an elongated discharge opening; an elongated transflow blower in said housing having a longitudinal blower axis; means to mount said housing and said transflow blower adjacent the roller in a lithographic printing press such that said blower axis and the roller axis are substantially parallel; and an electric motor to rotate said transflow blower to draw air through said elongated intake opening along substantially the entire length of the roller and to deliver air through said elongated discharge opening toward the surface of the roller along substantially the entire length of the roller to evaporate dampening fluid from the surface of the roller.

10. A lithographic printing press comprising: a pair of press side frames; a plate cylinder rotatably secured between said press side frames; a printing plate secured to said plate cylinder; a plurality of form rollers rotatably secured between said side frames and positioned to apply ink to said printing plate; a plurality of vibrator rollers rotatably secured between said press side frames and mounted in rolling engagement with said form rollers; at least one ink distributor roller rotatably mounted between said press side frames and in rolling relation with at least one of said vibrator rollers; transflow blower means having an elongated intake passage extending longitudinally of said distributor roller; means mounting said transflow blower means such that opposite ends of said intake passage are positioned adjacent opposite ends of said distributor roller; and drive means rotating said transflow blower means for delivering air to evaporate liquid carried on said distributor roller.

11. A lithographic printing press according to claim 10, said drive means comprising: an electric motor.

12. A lithographic printing press according to claim 10, said transflow blower means comprising: a blower housing having an inlet passage and an outlet passage formed therein; and a fan in said blower housing constructed and arranged to draw air from adjacent said distribution roller along the length of said distributor roller into said blower housing and to dispense a stream of diffused air to impinge against said distributor roller for evaporating liquid from said distributor roller.

13. A printing press according to claim 12, with the addition of: U-clamps secured to said blower housing to support said blower between said press side frames.

14. A printing press according to claim 12, said transflow blower comprising: a plurality of blades, each of said blades having a tip and a heel; a pair of solid end shrouds; means mounting said blades between said end shrouds such that the tip of each blade points in the direction of rotation and such that the heel of each blade is positioned circumferentially rearwardly of said blade tip to form forwardly curved blades.

15. A lithographic printing press comprising: a pair of press side frames; inker means supported by said press side frames; printing means adjacent said inker means; dampener means associated with said inker means for delivering ink and dampening fluid to said printing means, said inker means including distributor roller means; an elongated transflow blower having a longitudinal axis; a blower housing having elongated inlet and outlet passages; means rotatably securing said transflow blower in said blower housing; means securing said blower housing relative to press side frames such that said elongated inlet and outlet passages into said transflow blower housing are positioned adjacent distributor roller; and drive means to rotate said transflow blower to deliver air directly from said elongated outlet passage onto said distributor roller along the length of said distributor roller to evaporate dampening fluid.

16. A lithographic printing press comprising: a pair of press side frames; a plate cylinder rotatably secured between said side frames; a printing plate secured to said plate cylinder; a plurality of form rollers rotatably secured between said side frames and positioned to apply ink to said printing plate; a plurality of vibrator rollers rotatably secured between said side frames and mounted in rolling engagement with said form rollers; at least one ink distributor roller rotatably mounted between said side frames and in rolling relation with at least one of said vibrator rollers; a blower housing having an inlet passage and an outlet passage formed therein; means secured to said blower housing to support said blower housing to the printing press; blower means in said blower housing constructed and arranged to draw air from adjacent substantially the entire length of said roller surface into said blower housing and to dispense a stream of diffused air directly from said housing to impinge against the roller surface along substantially the entire length of the roller for evaporating liquid from the surface of the roller, said blower being mounted for rotation about a longitudinal axis between said side frames; and an electric motor rotating said transflow blower for delivering air to evaporate liquid carried on the surface of said distributor roller.

* * * * *